US006332452B1

(12) United States Patent
Debusmann et al.

(10) Patent No.: US 6,332,452 B1
(45) Date of Patent: Dec. 25, 2001

(54) METHOD FOR TORQUE MONITORING IN THE CASE OF OTTO ENGINES IN MOTOR VEHICLES

(75) Inventors: Martin Debusmann, Karlsruhe; Tobias Roulet, Leonberg, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/536,939

(22) Filed: Mar. 28, 2000

(30) Foreign Application Priority Data

Apr. 13, 1999 (DE) ..... 199 16 725

(51) Int. Cl.[7] ..... F02D 41/40

(52) U.S. Cl. ..... 123/406.23; 123/430; 123/406.45; 123/350; 701/101; 701/102

(58) Field of Search ..... 123/406.23, 406.24, 123/406.26, 406.33, 406.45, 488, 350, 443, 430; 701/101, 102

(56) References Cited

U.S. PATENT DOCUMENTS 5,245,966 * 9/1993 Zhang et al. ..... 123/339.19
5,467,750 * 11/1995 Braun et al. ..... 123/350
5,676,111 * 10/1997 Zhang ..... 123/325
5,755,198 * 5/1998 Grob et al. ..... 123/295
5,819,705 * 10/1998 Scherer et al. ..... 123/357
5,854,990 * 12/1998 Reckzugel et al. ..... 701/101

FOREIGN PATENT DOCUMENTS 19536038 4/1997 (DE) .
19624822 8/1997 (DE) .

* cited by examiner

*Primary Examiner*—John Kwon
*Assistant Examiner*—Hieu T. Vo
(74) *Attorney, Agent, or Firm*—Crowell & Moring LLP

(57) ABSTRACT

The invention proposes a method for torque monitoring in the case of Otto engines in motor vehicles, in which a reference torque value ($M_0$) is derived from the speed (n) of the Otto engine and the air mass (L) supplied and, in homogeneous lean operation (lambda=1 to 1.4), this reference torque value ($M_0$) is corrected by a signal derived from a signal ($\lambda_{ist}$) from a lambda probe and is then compared with a torque value ($M_{max}$) specified by the driver. Torque-reducing interventions in the control of the engine are performed if the corrected reference torque value ($M_0$) exceeds the torque value ($M_{max}$) specified by the driver by a specifiable factor or value. This method allows reliable and accurate torque monitoring, even at lambda values greater than 1.

14 Claims, 2 Drawing Sheets

L
n
AGR
ZW ist
λ ist
K
n
M o
ZW o
M o ( λ =1 , ZW o)
ΔZW
ΔZW(λ)
0 ... 100%
60% ... 100%
M max
<0
M g
10
11
12
13
14
15
16
17
18
19
20
21
22
23
24
25

METHOD FOR TORQUE MONITORING IN THE CASE OF OTTO ENGINES IN MOTOR VEHICLES

CROSS REFERENCE TO RELATED APPLICATION

Priority is claimed with respect to German Application No. 199 16 725.7-26 filed in Germany on Apr. 13, 1999, the disclosure of which is incorporated herein by reference.

BACKGROUND OF THE INVENTION

1. Technical Field

The invention relates to a method for torque monitoring in the case of Otto engines in motor vehicles, in which a reference torque value is derived from the speed of the Otto engine and the air mass supplied and compared with a torque value specified by the driver, torque-reducing interventions in the control of the engine being performed if the reference torque value exceeds the torque value specified by the driver by a specifiable factor or value.

2. Discussion

SUMMARY OF THE INVENTION

Systems previously employed in practice for monitoring the torque desired by the driver in the case of Otto engines take account only of operation at a lambda value of 1, i.e. for an air/fuel mixture which is always in fixed association. To monitor the torque output by the engine, the parameters relevant for operation at lambda=1 are detected and evaluated. These are essentially the variables air mass flow, engine speed and possibly also the ignition angle. The torque of the engine is determined by means of characteristic maps and efficiencies (ignition angle). This calculated torque is compared with a maximum permitted torque desired by the driver. If a threshold is exceeded, fault responses, such as safety fuel cut-off or switching off of the throttle-valve output stages, are triggered.

The air mass is detected by an air-mass sensor or pressure sensor and its plausibility is assessed with the throttle valve. The ignition angle output is compared with a reference ignition angle at which the engine has the maximum torque, in the case of a lambda value of 1, and this is then used to form an ignition-angle efficiency which is multiplied directly with the reference torque (maximum torque at lambda=1).

This known monitoring system is not suitable for extended operating ranges of the Otto engine, especially of an Otto engine with direct injection, since here the torque-determining variables are not just the air mass and the ignition angle but, in addition, the fuel quantity or mass supplied or injected. For better efficiency, the engine is as far as possible unthrottled. For an Otto engine with direct injection, this results essentially in two additional ranges: homogeneous lean operation, in which lambda=1 to 1.4, and stratified operation, in which lambda is significantly greater than 1.4. In these operating modes, the known torque monitoring system leads to unsatisfactory and much too inaccurate results.

One object of the present invention is thus to provide a method for torque monitoring which allows more accurate torque monitoring, at least in homogeneous lean operation of the Otto engine.

The present invention concerns a method for torque monitoring in Otto engines disposed in motor vehicles. A reference torque value (Mo) is derived from the speed (n) of the Otto engine and the air mass (L) supplied and, in homogenous lean operation (lambda=1 to 1.4), this reference torque value is corrected by a signal derived from a signal (λist) from a lambda probe and is then compared with a torque value (Mmax) specified by the driver. Torque reducing intervention means, such as safety fuel cut-off, switching off the throttle-valve output stages or a fault response are employed in control of the engine if the corrected reference torque value (Mo) exceeds the torque value (Mmax) specified by the driver by a specifiable amount. This method provides reliable and accurate torque monitoring when lambda values are greater than 1.

Since, according to the invention, the torque determined at a lambda value of 1 in homogeneous lean operation is multiplied by an efficiency dependent on the lambda value, accurate torque monitoring which includes automatic adaptation to different lambda values is possible, even in homogeneous lean operation.

Particularly simple and effective correction is achieved by virtue of the fact that the signal from the lambda probe is converted by means of a function stage or a characteristic map into a correction signal, and the latter acts by multiplication on the reference torque value.

Further improvements to torque monitoring are achieved by virtue of the fact that a reference ignition-angle signal and an actual ignition-angle signal and/or an exhaust-gas recirculation offset signal and/or an ignition-angle difference signal dependent on the lambda signal are used to form a correction ignition-angle signal which acts in the form of a correction factor on the reference torque value by multiplication. Since the optimum ignition value differs from that at a lambda value of 1 in the region of lambda values between 1 and 1.4, this additional corresponding correction increases the accuracy of torque monitoring in homogeneous lean operation considerably.

It is expedient if the correction ignition-angle signal is converted into the correction factor by means of a function stage or a characteristic map.

The reference ignition-angle signal is formed in a simple manner from the engine-speed signal and the air-mass signal by means of a characteristic map.

In stratified operation, the torque output by the engine depends almost exclusively on the engine speed and the fuel mass. In stratified operation, the ignition angle is almost completely dependent on the fuel mass and therefore does not play a significant part in a monitoring function. It is therefore particularly advantageous for torque monitoring in stratified operation to be performed by a method which has the features of claim 7. The engine torque which is output, i.e. the reference torque value, is then preferably determined by means of a characteristic map as a function of the engine speed and the fuel mass supplied.

Since the methods for torque monitoring for homogeneous lean operation and stratified operation differ significantly, it is advantageous if a detection stage, designed as a function stage or characteristic map, is provided for these operating modes, a changeover between the respectively associated comparison methods for these operating modes being effected by this detection stage. A changeover characteristic map with a tolerance band above which stratified operation is permissible is particularly suitable here.

The torque value specified by the driver is likewise expediently determined as a function of the accelerator-pedal position by means of a characteristic map or a function stage.

A particularly advantageous configuration of the method according to the invention consists in plausibility-checking the actual lambda value in homogeneous lean operation and the desired fuel mass in stratified operation. This is intended to detect a faulty lambda probe or incorrect determination of the desired fuel mass. According to the invention, the respective operating state is disabled or prevented in the case of a specifiable amount by which the variable to be monitored (lambda value or desired fuel-mass value) exceeds the corresponding variable determined from the characteristic map.

In homogeneous lean operation, it is advantageous if a desired lambda value is determined by means of a characteristic map as a comparison variable obtained from the air mass value and the fuel mass value. An actual fuel-mass value is determined in a corresponding manner by means of a characteristic map as a comparison variable obtained from the actual lambda value and the air mass value. Since the fuel mass used to calculate the torque has to be assessed for plausibility as part of safety monitoring, it is necessary here, as with the lambda signal, to carry out suitable monitoring of the actually injected fuel mass. Similarly to the solution in the case of homogeneous lean operation, the lambda probe is used to monitor the air/fuel mixture. In this process, the inverse ratio of the actual lambda value to the air mass supplied is formed and the resulting fuel mass is determined and compared to the desired fuel mass. If there is an upward deviation, i.e. if more fuel is injected than specified, stratified operation is disabled. The same applies in the case of a lambda-probe fault. The changeover between the two types of plausibility check for the two operating modes can once again expediently be performed by means of a changeover characteristic map.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

An exemplary embodiment of the invention is illustrated in the drawing and explained in greater detail in the following description. In the drawing.

DETAILED DESCRIPTION OF THE DRAWINGS

An method for torque monitoring in the case of Otto engines in motor vehicles is provided. In the following description, numerous specific details are set forth in order to provide a more comprehensive description of the present invention. It will be apparent, however, to one skilled in the art, that the present invention may be practiced without these specific details. In other instances, specific details of well-known features have not been described so as not to obscure the present invention.

The foregoing description constitutes the preferred embodiments devised by the inventors for practicing the invention. It is apparent, however, that the invention is susceptible to modification, variation and change that will be obvious to those skilled in the art. Inasmuch as the foregoing description is intended to enable one skilled in the pertinent art to practice the invention, it should not be construed to be limited thereby but should be construed to include such aforementioned obvious variations and be limited only by the proper scope or fair meaning of the accompanying claims.

Figure 1:
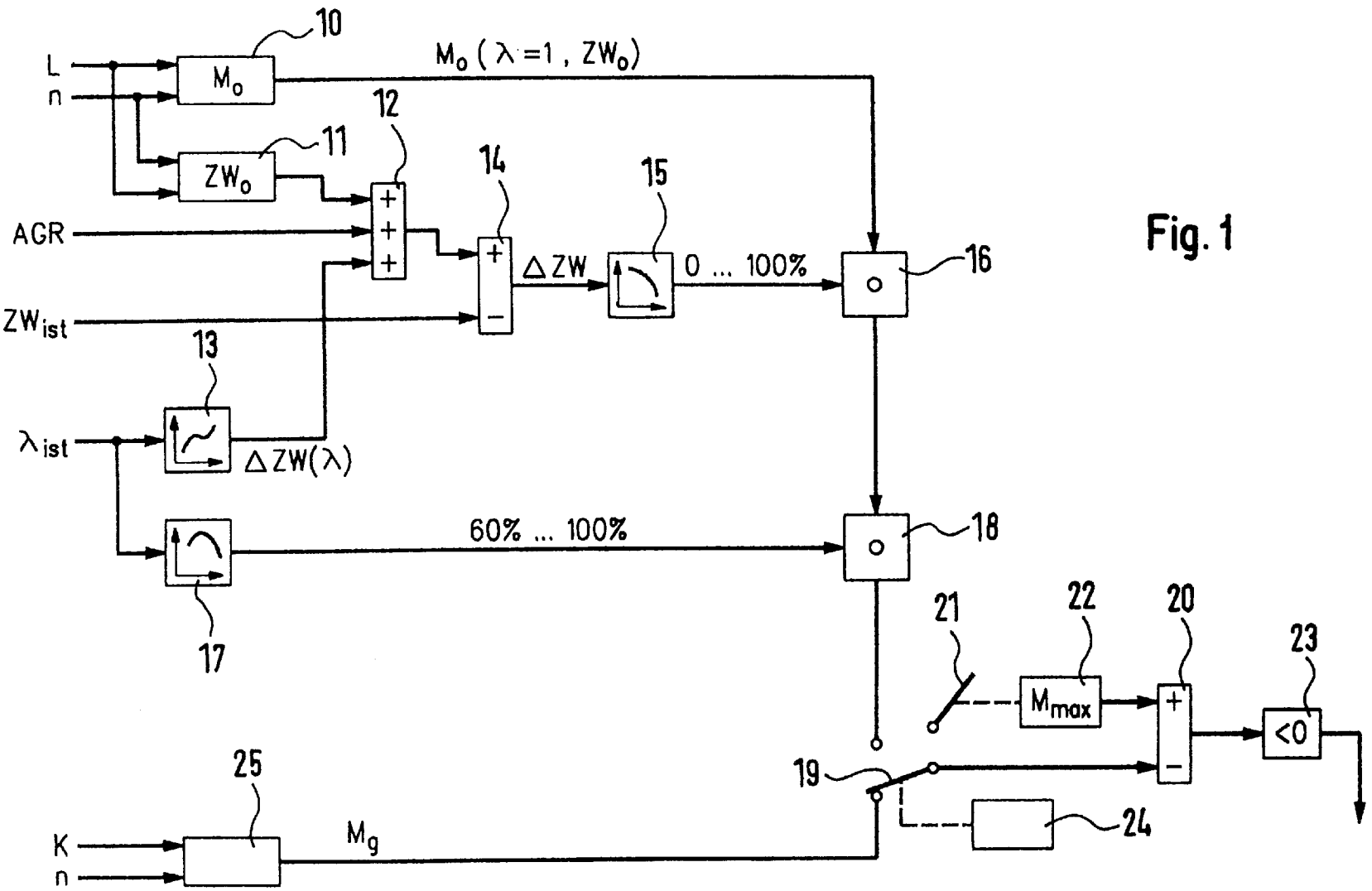
FIG. 1 shows a block diagram for the purpose of explaining the method for torque monitoring in the case of Otto engines in motor vehicles for homogeneous lean operation and stratified operation as an exemplary embodiment of the invention and FIG. 2 shows a block diagram for the purpose of explaining the plausibility check.

The exemplary embodiment, illustrated as a block diagram in FIG. 1, of an apparatus for torque monitoring in the case of Otto engines in motor vehicles is implemented in the motor vehicle with the aid of a microcomputer, e.g. a microcomputer which is present in any case in a central engine control system. This microcomputer has, in the usual way, working memory and read-only memory, in which characteristic maps can be stored, these being referred to below simply as characteristic maps.

The air mass L is ascertained by means of a customary air-mass sensor or pressure sensor in the intake duct. A customary engine-speed sensor is used to ascertain the engine speed n. For exhaust gas recirculation AGR, either a controllable valve is provided in an exhaust-gas recirculation line or exhaust-gas recirculation is performed under pressure or vacuum control. In either case, there is an exhaust-gas recirculation signal AGR which characterizes the exhaust-gas recirculation process. The actual ignition angle $ZW_{ist}$ is usually produced by an ignition control unit and is determined on the basis of computed variables. The actual lambda value $\lambda_{ist}$ is produced by a customary lambda sensor or a lambda probe. The fuel mass K fed to the Otto engine is derived from the driver's demand, i.e. from the position of the accelerator pedal by means of computational processes or characteristic maps.

First of all, a reference torque $M_0$, i.e. the torque which would be present at lambda=1 and an optimum ignition angle $ZW_0$, is formed in a characteristic map 10 as a function of the air mass or air mass flow L present and the engine speed n. The same input variables L and n are then used in a second characteristic map 11 to form a reference ignition angle $ZW_0$ which represents the optimum ignition angle. This optimum ignition angle $ZW_0$ is combined in an adder stage 12 with an offset signal for the purpose of taking into account the exhaust-gas recirculation AGR and a correction ignition angle $\Delta ZW(\lambda)$ dependent on the actual lambda value $\lambda_{ist}$. This correction ignition angle $\Delta ZW(\lambda)$ is formed as a function of the lambda signal $\lambda_{ist}$ by means of a function stage 13 or function combination, it also being possible here to use a characteristic map. The corrected ignition-angle signal formed at the output of the adder stage 12 is compared with the actual ignition-angle signal $ZW_{ist}$ in a comparison stage 14, giving an ignition-angle difference signal $\Delta ZW$ at the output if the actual ignition-angle signal differs from the corrected, calculated ignition-angle signal. This ignition-angle difference signal $\Delta ZW$ is used in a function stage 15 (or a characteristic map) to form an ignition-angle efficiency, which is combined by multiplication with the reference torque $M_0$ in a multiplication stage 16.

A lambda-dependent efficiency signal is additionally formed from the actual lambda value $\lambda_{ist}$ by means of a function stage 17, which could also be a characteristic map, and this efficiency signal is combined by multiplication in a multiplication stage 18 with the reference torque $M_0$ already corrected in the first instance by multiplication by the multiplication stage 16.

The reference torque $M_0$ corrected in this way as a function of the exhaust-gas recirculation AGR, the actual ignition value $ZW_{ist}$ and the actual lambda value $\lambda_{ist}$ now represents the optimized reference torque for homogeneous lean operation of the Otto engine, in particular of the Otto engine with direct injection. In homogeneous lean operation, an operation changeover switch 19 is in the position opposite to that shown in FIG. 1, with the result that this corrected reference torque $M_0$ is applied to a comparison stage 20, to the comparison input of which a maximum driver-requested torque $M_{max}$ is applied. This torque is determined by means of a characteristic map 22 as a function of the position of an accelerator pedal 21.

In a switching stage 23 connected to the output of the comparison stage 20, the system checks whether the reference torque $M_0$ determined and corrected exceeds the maximum driver-requested torque $M_{max}$ or exceeds it by a specifiable amount or factor. If this is the case, there must be an operating error and fault responses, such as safety fuel cut-off or switching off of the throttle-valve output stages, are triggered to reduce the torque.

In stratified operation (lambda significantly greater than 1.4), the torque output by the Otto engine depends almost exclusively on the engine speed and fuel mass. In stratified operation, the ignition angle is almost completely dependent on the fuel mass and therefore does not play a significant part in the monitoring function. A detection characteristic map 24 for the respective operating mode is used to actuate the operation changeover switch 19 and is placed in the position illustrated in FIG. 1 for stratified operation. The reference torque $M_g$ for stratified operation is determined and fed to the comparison stage 20 by means of a characteristic map 25 as a function of fuel mass K and the engine speed n. For stratified operation too, a corresponding comparison with the maximum driver-requested torque $M_{max}$ is then performed, and torque-reducing measures are initiated if $M_g$ exceeds the value $M_{max}$ by a specifiable factor or value.

Figure 2:
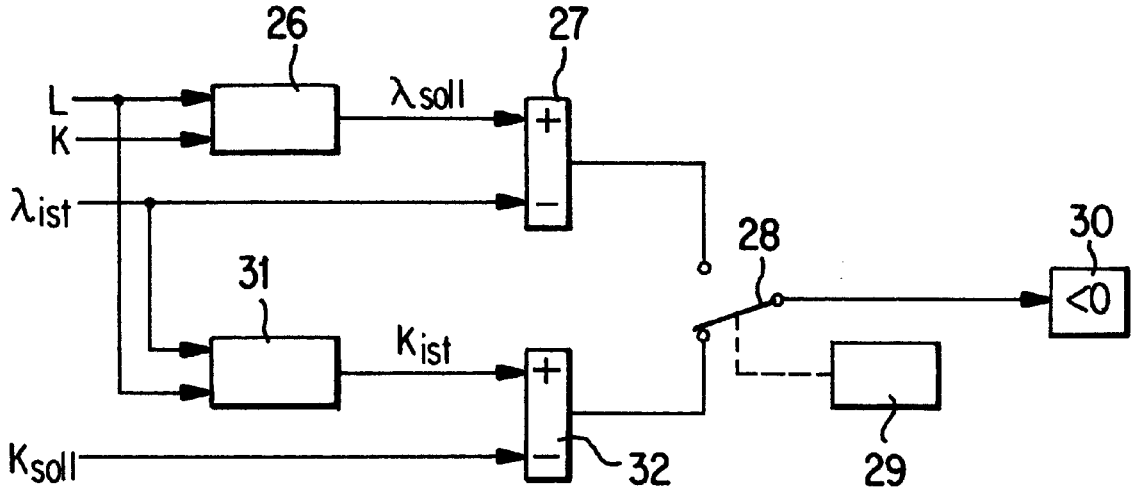

According to FIG. 2, safety monitoring or plausibility checking is furthermore carried out to ascertain whether the actual lambda value from the lambda probe in homogeneous lean operation is acceptable or whether the desired fuel mass determined is correct or plausible for stratified operation.

For this purpose a desired lambda value $\lambda_{soll}$ is first of all determined for homogenous lean operation by means of a characteristic map 26 using the variables supplied, namely air mass or air mass flow L, and the fuel mass K supplied. This value $\lambda_{soll}$ is now compared in a comparison stage 27 to the value $\lambda_{ist}$. By means of an operation changeover switch 28 which can be switched off in dependence on a detection characteristic map 29, the output of the comparison stage 27 is now fed to a switching stage 30. As long as $\lambda_{ist}$ is larger than $\lambda_{soll}$, there is no response by the switching stage 30, i.e. such a state is regarded as correct. If, however, $\lambda_{ist}$ is smaller than $\lambda_{soll}$ (by a specifiable amount or factor), a fault is detected, and this can be displayed, an alternative or additional possibility being, for example, that of disabling homogeneous lean operation.

Detection characteristic map 29 performs the same function as detection characteristic map 24, allowing the same detection characteristic map to be used for both operation changeover switches 19, 28.

Since the fuel mass is used to calculate the torque $M_g$ in stratified operation, the plausibility of this fuel mass must here be assessed during safety monitoring or plausibility checking. Here, the variables supplied, $\lambda_{ist}$ and the air mass or air mass flow L, are used to determine the actual fuel mass supplied by means of a characteristic map 31. This actual fuel mass $K_{ist}$ now compared with the desired fuel mass $K_{soll}$ in a comparison stage 32. By means of the operation changeover switch 28 and the switching stage 30, a check is now once again made to determine whether $K_{soll}$ is larger than $K_{ist}$. In this case, no intervention is made and the values are regarded as correct. Otherwise, i.e. $K_{ist}$ becomes larger than $K_{soll}$, stratified operation is disabled.

Since monitoring can only be carried out when the probe is ready for operation, stratified operation is only enabled in this case. This is consistent with an operating range with a stratified charge as regards cold starting since the lambda value is 1 when cold starting, even in the case of Otto engines with direct injection.

As an addition to or modification of the plausibility check described, time filters and dead times for the measuring sensors can furthermore be provided in order to exclude corresponding errors.

What is claimed is:

1. A method for monitoring torque in an engine for use in a motor vehicle, said engine having a lambda probe giving a lambda for the operation of the engine, said method comprising the steps of:

operating the engine in a stratified condition, wherein lambda is greater than 1.4, said operating said engine in said stratified condition comprises the steps of:

identifying a speed (n) of the engine;

identifying a fuel mass (K) supplied to the engine;

deriving a reference torque value ($M_g$) from said speed (n) and said fuel mass (K);

comparing said reference torque value ($M_g$) with a torque value ($M_{max}$) specified by a driver of the vehicle;

performing torque-reducing intervention means if said reference torque value ($M_g$) exceeds said torque value ($M_{max}$) by a specifiable amount.

2. A method for monitoring torque in an engine for use in a motor vehicle, said engine having a lambda probe giving a lambda for the operation of the engine, said method comprising the step of:

operating the engine in a homogeneous lean condition, wherein lambda is between 1 and 1.4, said operating said engine in said homogeneous lean condition comprises the steps of:

identifying a speed (n) of the engine;

identifying an air mass (L) supplied to the engine;

deriving a reference torque value ($M_o$) from said speed (n) and said air mass (L);

identifying a lambda signal ($\lambda_{ist}$) from the lambda probe;

correcting said reference torque value ($M_o$) by said lambda signal and comparing said reference torque value with a torque value ($M_{max}$) specified by a driver of the vehicle;

performing torque-reducing intervention means if said reference torque value exceeds said torque value ($M_{max}$) by a specifiable amount.

3. The method as set forth in claim 2, further comprising the step of converting said lambda signal into a correction signal by use of a function (17), modifying said reference torque value by multiplication with said correction signal.

4. The method as set forth in claim 2, further comprising the steps of:

identifying a reference ignition-angle signal ($ZW_o$);

identifying at least one of an actual ignition-angle signal ($ZW_{ist}$), an exhaust gas recirculation offset signal (AGR), and an ignition-angle difference signal ($\Delta ZW(\lambda)$) dependent on said lambda signal, forming a correction ignition-angle signal ($\Delta ZW$) from said reference ignition-angle signal ($ZW_o$) and at least one of said actual ignition-angle signal ($ZW_{ist}$), said exhaust gas recirculation offset signal (AGR), and said ignition-angle difference signal ($\Delta ZW$ ($\lambda$)) dependent on said lambda signal;

modifying said reference torque value by multiplication with said correction-angle signal ($\Delta ZW$).

5. The method as set forth in claim 4, wherein said reference ignition-angle signal ($ZW_o$) and at least one of said actual ignition-angle signal ($ZW_{ist}$), said exhaust gas recirculation offset signal (AGR), and said ignition-angle difference signal ($\Delta ZW$ ($\lambda$)) dependent on said lambda signal are combined by either addition or subtraction to form said correction ignition-angle signal ($\Delta ZW$).

6. The method as set forth in claim 4, wherein said correction ignition-angle signal ($\Delta ZW$) is modified by a function (15).

7. The method as set forth in claim 4, further comprising the step of forming said reference ignition-angle signal ($ZW_o$) from said speed (n) of the engine and said air mass (L) of the engine by using a function (11).

8. The method as set forth in claim 2, further comprising the step of:

operating the engine in a stratified condition, wherein lambda is greater than 1.4, said operating said engine in said stratified condition comprises the steps of:

identifying a speed (n) of the engine;

identifying a fuel mass (K) supplied to the engine;

deriving a reference torque value ($M_g$) from said speed (n) and said fuel mass (K);

comparing said reference torque value ($M_g$) with a torque value ($M_{max}$) specified by a driver of the vehicle;

performing torque-reducing intervention means if said reference torque value (Mg) exceeds said torque value ($M_{max}$) by a specifiable amount.

9. The method as set forth in claim 8, further comprises the step of:

detecting when said engine is operating in said homogeneous lean operation or in said stratified condition, and providing a changeover switch to change between operating said engine in said homogeneous lean operation and in said stratified condition.

10. The method as set forth in claim 8, further comprising the steps of:

determining said reference torque value ($M_0$) by use of a characteristic map (10) and determining said reference torque value ($M_g$) by use of a characteristic map (25).

11. The method as set forth in claim 8, wherein said torque value ($M_{max}$) specified by the driver is determined as a function of the accelerator pedal position and a characteristic map (22).

12. The method as set forth in claim 8, further comprising the step of conducting a plausibility check wherein either said lambda signal ($\lambda_{ist}$) is compared with a desired lambda value ($\lambda_{soll}$) or an actual fuel mass ($K_{ist}$) is compared with a desired fuel mass ($K_{soll}$).

13. The method as set forth in claim 12, wherein during homogenous lean operation, said desired lambda value ($\lambda_{soll}$) is determined by said characteristic map (26) as a comparison value obtained from said air mass value (L) and said fuel mass value (K), said lean homogenous operation of said engine being disabled when said lambda signal ($\lambda_{ist}$) exceeds the corresponding characteristic map (26) value by a specifiable amount.

14. The method as set forth in claim 12, wherein during stratified operation, said actual fuel mass ($K_{ist}$) is determined by use of a characteristic map (31) as a comparison variable obtained from said lambda signal ($\lambda_{ist}$) and said air mass value (L), said operation of said engine in the stratified condition being disabled when said actual fuel mass ($K_{ist}$) exceeds the corresponding characteristic map (31) value by a specifiable amount.

* * * * *